US006836206B2

(12) United States Patent
Lee

(10) Patent No.: US 6,836,206 B2
(45) Date of Patent: Dec. 28, 2004

(54) APPARATUS DIAGNOSING A BREAKING OF A FUSE FOR A VEHICLE

(75) Inventor: Byung Cheon Lee, Kyungki-Do (KR)

(73) Assignee: Hyundai Motor Company, Seoul (KR)

( * ) Notice: Subject to any disclaimer, the term of this patent is extended or adjusted under 35 U.S.C. 154(b) by 72 days.

(21) Appl. No.: 10/331,248

(22) Filed: Dec. 30, 2002

(65) Prior Publication Data

US 2004/0027227 A1 Feb. 12, 2004

(30) Foreign Application Priority Data

Aug. 12, 2002 (KR) ..... 10-2002-0047462

(51) Int. Cl.[7] ..... H01H 85/30

(52) U.S. Cl. ..... 337/243; 337/241; 337/206; 116/206; 324/550

(58) Field of Search ..... 337/241–243, 337/245, 265, 266, 206; 439/490, 491; 324/507, 550; 340/638, 639; 361/835; 81/3.8; 116/202, 206, 207

(56) References Cited

U.S. PATENT DOCUMENTS

| | | | | | |
|---|---|---|---|---|---|
| 737,369 | A | * | 8/1903 | Downes | 337/243 |
| 809,978 | A | * | 1/1906 | Ogle | 337/243 |
| 2,164,658 | A | * | 7/1939 | Lyon | 337/242 |
| 2,175,250 | A | * | 10/1939 | Burrows et al. | 337/243 |
| 2,989,739 | A | * | 6/1961 | Wilson | 340/638 |
| 3,190,987 | A | * | 6/1965 | Fister | 337/261 |
| 3,764,796 | A | * | 10/1973 | Gilliam et al. | 362/34 |
| 3,844,248 | A | * | 10/1974 | Parker | 116/202 |
| 3,938,465 | A | * | 2/1976 | Lyons | 116/63 P |
| 3,940,604 | A | * | 2/1976 | Rauhut | 362/34 |
| 4,064,428 | A | * | 12/1977 | Van Zandt | 362/34 |
| 4,158,349 | A | * | 6/1979 | Goto et al. | 123/406.7 |
| 4,186,426 | A | * | 1/1980 | Gingras et al. | 362/34 |
| 4,475,283 | A | * | 10/1984 | Olson et al. | 29/720 |
| 4,499,447 | A | * | 2/1985 | Greenberg | 337/266 |
| 4,712,081 | A | * | 12/1987 | Bosley | 337/266 |
| 4,771,724 | A | * | 9/1988 | Baretz et al. | 116/202 |
| 4,959,756 | A | * | 9/1990 | Dodson | 362/34 |
| 4,972,300 | A | * | 11/1990 | Beisswanger et al. | 362/34 |
| 5,430,622 | A | * | 7/1995 | Kuo | 362/34 |
| 5,446,629 | A | * | 8/1995 | Steiger et al. | 362/34 |
| 5,552,968 | A | * | 9/1996 | Ladyjensky | 362/34 |
| 5,781,095 | A | * | 7/1998 | Dietsch et al. | 337/243 |
| 5,821,849 | A | * | 10/1998 | Dietsch et al. | 337/241 |

* cited by examiner

*Primary Examiner*—Anatoly Vortman
(74) *Attorney, Agent, or Firm*—Morgan Lewis & Bockius LLP

(57) ABSTRACT

An apparatus for diagnosing a tripped fuse is disclosed. The apparatus employs a chemical light installed at an upper portion of the fuse housing. A system for activating the chemical light is installed at the lower end of the housing. The activation system activates the light when an excessive current melts a soft iron element.

9 Claims, 1 Drawing Sheet

APPARATUS DIAGNOSING A BREAKING OF A FUSE FOR A VEHICLE

FIELD OF THE INVENTION

The present invention relates to a fuse for vehicle circuits. More particularly, it relates to an apparatus for diagnosing the breaking of a fuse that confirms the fuse is broken by activating a chemical light.

BACKGROUND OF THE INVENTION

The most recent developments in the electrical industry for convenience and safety are installed in the latest vehicles more frequently than ever before. This tendency has led to a corresponding increase in the use of fuses, which open to protect a circuit in case of an excessive current. It is, therefore, an important matter whether a fuse is tripped or not because it may control the function of one of the safety apparatuses.

A tripped fuse is typically found by inspection. The typical fuse generally includes a pair of connecting terminals that are connected through electric wires to an electric power source terminal and a ground, respectively. The typical fuse also contains a soft iron element that connects the pair of connecting terminals to each other. The soft iron element melts when an excessive current flows through it and isolates the pair of connecting terminals from each other. A pair of conductive terminals on the outside of the typical fuse are used for confirming whether the soft iron element is broken.

When checking whether the fuse is tripped, a dedicated tester may be used. The melting of the soft iron element is confirmed by checking whether there is connectivity between the pair of conductive terminals. But it is difficult to check the state of the fuse using the naked eye and dedicated testers are rare. Thus, time is taken unnecessarily because a general tester must be used.

SUMMARY OF THE INVENTION

A preferred embodiment of the present invention includes a pair of connecting terminals that are connected through electric wires with an electric power source terminal and a ground, respectively, a soft iron element that connects the pair of connecting terminals with each other, the soft iron element melting the pair of connecting terminals from each other when an excessive current flows through the soft iron element, and a pair of conductive terminals that are used for confirming whether the connecting terminals are isolated from each other from outside the apparatus. A chemical light is installed in an upper portion of a housing of the fuse. An activation system for activating the chemical light 14 to radiate is installed at a lower end of the housing. Chemical mixtures react when the activation system is operated by the melting of the soft iron element, thereby radiating light.

In a preferred embodiment of the invention, an apparatus for diagnosing a tripped fuse, comprises a light visible on the surface of a fuse; and an activation system comprising an elastic element, wherein the activation system activates the light when the fuse is tripped. In a preferred embodiment the light is a chemical light and comprises: an oxalate; and an activator that when mixed with the oxalate creates light, wherein the activator and the oxalate are caused to mix by an action of the elastic element. Also, a preferred embodiment comprises a glass tube containing the actuator; and a housing containing the oxalate, wherein the glass tube and housing are dimensioned and configured so that if the glass tube broke the activator would mix with the oxalate, and wherein the action of the elastic element is to exert force against the glass tube to break the glass tube. A further preferred embodiment comprises a soft iron element, wherein the soft iron element restrains the elastic element and prevents the elastic element from returning to a first position, and wherein the activating system activates the light by allowing the elastic element to move toward the first position. Additional, a preferred embodiment comprises a wire connecting the elastic element to the soft iron element and wherein the activation system allows the elastic element to move toward the first position in response to an excessive current flowing through and melting the soft iron element.

BRIEF DESCRIPTION OF THE DRAWINGS

The above objects and other characteristics and advantages of the present invention will become more apparent in the following detailed description of a preferred embodiment, with reference to the attached drawings, in which.

Like numbers refer to similar elements throughout the several drawings.

DETAILED DESCRIPTION OF THE INVENTION

Figure 1:
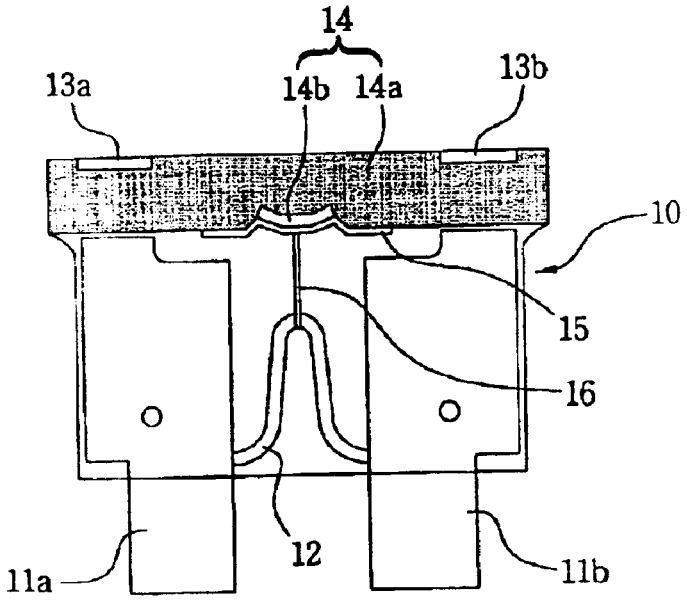
FIG. 1 is a sectional view of a fuse and an apparatus for diagnosing the fuse according to a preferred embodiment of the present invention.
Figure 2:
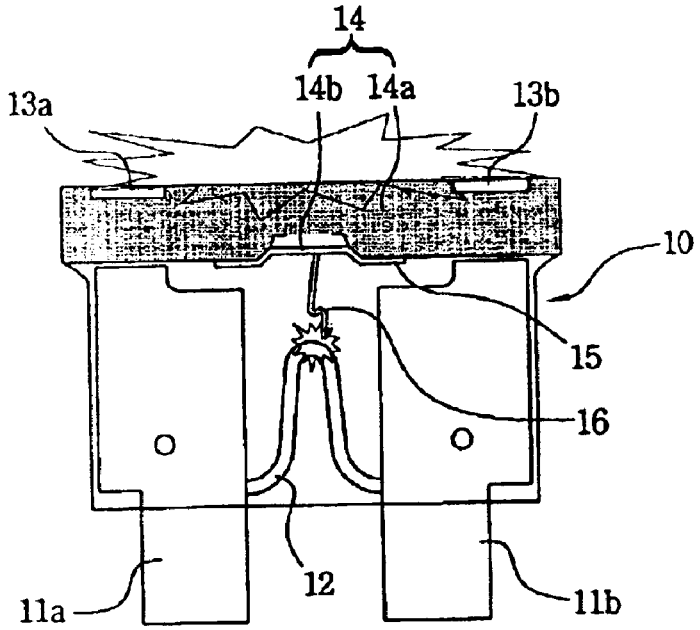
FIG. 2 is a view illustrating an operation state of the apparatus of FIG. 1.

A preferred embodiment of the present invention, as shown in FIG. 1, includes a chemical light 14 that is received in an upper portion of a housing of a fuse 10, and an activation system for causing the chemical light 14 to radiate light. The activation system is installed at the lower end of the housing and connects to the fuse 10. The fuse 10 includes a pair of connecting terminals 11*a* and 11*b* that are connected through electric wires to an electric power source terminal and a ground, respectively. A soft iron element 12 connects the connecting terminals 11*a* and 11*b* with each other. A pair of conductive terminals 13*a* and 13*b* on the outside of fuse 10 are used for confirming whether the soft iron element 12 is broken.

The activation system preferably includes a plate spring 15 for applying an elastic force to chemical light 14 that causes a glass tube 14*b* of the chemical light 14 to burst. A wire 16 causes the soft iron element 12 to maintain the plate spring 15 in a tensioned state The chemical light 14 is observable from the exterior of the fuse 10. Glass tube 14*b* contains an activator. The activator may be a chemical mixture having dimethyl phthalate (DMP), butanol, hydrogen peroxide, etc. A chemical mixture called the "oxalate", having DBP, oxalic chloride, dye, etc., is included in the outer shell 14*a*. Light radiating chemical compositions and reactions are not described in detail because the compositions and reactions are well known to those of ordinary skill in the art. But briefly, when the glass tube 14*b* is burst, the chemical mixture reacts with the oxalate so that a light is radiated.

The plate spring 15 is attached to a part of the outer shell 14*a*. The plate spring 15 is demarcated and pulled by the wire 16. Thus, plate spring 15 creates an upward tension in wire 16. The glass tube 14*b*, which is installed in the outer shell 14*a*, preferably has a shape of a curve and is attached to a middle portion of the plate spring 15. Glass tube 14*b* is relatively fragile. Therefore, when soft iron element 12 melts and releases wire 16, plate spring 15 elastically retracts against, and breaks, glass tube 14*b*. This causes the activator to mix with the oxalate and radiate light.

Furthermore, the plate spring 15 is preferably integrally formed on the outer shell 14*a*. Though a space is generated when the middle portion of the plate spring 15 is pulled, the space is filled because the outer shell 14*a* is made of a flexible material.

When the fuse 10 is not broken, the plate spring 15 is in tension with the wire 16 that is connected to the soft iron element 12. When the fuse 10 is broken, the tension is removed. The elastic force of the plate spring 15 is transferred to the capillary glass tube 14*b*, breaking the tube, and mixing the activator with the oxalate. Light is generated by the reaction of the activator and oxalate. A user confirms that the fuse is broken by observing a light on the surface of the fuse 10.

As described above, according to a preferred embodiment of the present invention, it is possible to easily and efficiently check the state of the fuse using the chemical light.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A fuse, comprising:

a pair of connecting terminals that are connected through electric wires with an electric power source terminal and a ground, respectively;

a soft iron element that connects the pair of connecting terminals with each other, the soft iron element melting and isolating the pair of connecting terminals from each other when an excessive current flows therethrough;

a pair of conductive terminals that are used for confirming whether the connecting terminals are isolated from each other from outside the apparatus using a tester;

a chemical light that is received by an upper portion of a housing of the fuse; and an activation system for activating the chemical light, wherein the activation system is installed at a lower end of the housing and has a structure for connecting the activation system with the fuse.

2. The fuse according to claim 1, wherein the activation system comprises:

a plate spring for applying an elastic force against the chemical light to cause a glass tube of the chemical light to burst; and a wire for connecting the soft iron element to the plate spring.

3. The fuse according to claim 2, wherein the plate spring is integrally formed with an outer shell, and wherein the plate spring is demarcated.

4. The fuse according to claim 2, wherein the glass tube is a capillary glass tube having a curved shape and being attached to a middle portion of the plate spring so that the capillary glass tube is burst by the elastic force of the plate spring.

5. An apparatus for diagnosing a tripped fuse, comprising:

a light visible on the surface of a fuse; and an activation system comprising an elastic element, wherein the activation system activates the light when the fuse is tripped;

wherein the light is a chemical light comprising an oxalate and an activator that, when mixed, creates light and wherein the activator and the oxalate are caused to mix by an action of the elastic element.

6. The apparatus of claim 5, further comprising:

a glass tube containing the activator; and a housing containing the oxalate, wherein the glass tube and housing are dimensioned and configured so that if the glass tube broke the activator would mix with the oxalate, and wherein the action of the elastic element is to exert force against the glass tube to break the glass tube.

7. The apparatus of claim 5, wherein the activation system further comprises:

a soft iron element, wherein the soft iron element restrains the elastic element and prevents the elastic element from returning to a first position, and wherein the activating system activates the light by allowing the elastic element to move toward the first position.

8. The apparatus of claim 7, further comprising a wire connecting the elastic element to the soft iron element and wherein the activation system allows the elastic element to move toward the first position in response to an excessive current flowing through and melting the soft iron element.

9. A fuse, comprising:

a fuse housing;

a soft iron element disposed within the housing and connected between fuse terminals, the soft iron element breaking in response to over current;

an outer shell over a portion of the housing;

a chemical light first material contained within the housing;

a frangible container positioned within the outer shell adjacent the chemical light first material;

a chemical light second material disposed in the frangible container, which when combined with said first material generates light;

a spring element disposed adjacent to the frangible container;

a connecting link between said spring element and soft iron element, wherein said connecting link holds said spring element in a loaded state such that breaking of the soft iron element causes the spring element to unload and break the frangible container, thus mixing said first and second chemical light materials.

* * * * *